US009484161B2

(12) United States Patent
Gericke et al.

(10) Patent No.: US 9,484,161 B2
(45) Date of Patent: Nov. 1, 2016

(54) ELECTRICAL SWITCHING DEVICE

(71) Applicant: SIEMENS AKTIENGESELLSCHAFT, Munich (DE)

(72) Inventors: Joachim Gericke, Berlin (DE); Robert Gruenler, Oranienburg (DE); Martin Krehnke, Berlin (DE); Volker Lehmann, Treuenbrietzen (DE); Friedrich Loebner, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 188 days.

(21) Appl. No.: 14/371,186

(22) PCT Filed: Dec. 18, 2012

(86) PCT No.: PCT/EP2012/075884
§ 371 (c)(1),
(2) Date: Jul. 9, 2014

(87) PCT Pub. No.: WO2013/104495
PCT Pub. Date: Jul. 18, 2013

(65) Prior Publication Data

US 2015/0014131 A1 Jan. 15, 2015

(30) Foreign Application Priority Data

Jan. 10, 2012 (DE) ..... 10 2012 200 238

(51) Int. Cl.
*H01H 3/46* (2006.01)
*H01H 33/24* (2006.01)
*H01H 1/06* (2006.01)

(Continued)

(52) U.S. Cl.
CPC ..... *H01H 3/46* (2013.01); *H01H 1/06* (2013.01); *H01H 21/36* (2013.01); *H01H 33/245* (2013.01); *H01H 3/42* (2013.01); *H01H 33/7023* (2013.01);

(Continued)

(58) Field of Classification Search
CPC ..... H01H 33/42; H01H 3/46; H01H 75/00; H01H 33/04; Y02T 403/7015; Y02T 403/7098; Y02T 403/7005
USPC ..... 200/279, 337; 74/567–569; 403/61
See application file for complete search history.

(56) References Cited

U.S. PATENT DOCUMENTS 2,460,216 A * 1/1949 Dalton ..... F16D 3/2052 403/152
3,814,883 A 6/1974 Milianowicz (Continued)

FOREIGN PATENT DOCUMENTS

CN 1898761 A 1/2007
CN 101116163 A 1/2008

(Continued)

*Primary Examiner* — Edwin A. Leon
*Assistant Examiner* — Iman Malakooti
(74) *Attorney, Agent, or Firm* — Laurence Greenberg; Werner Stemer; Ralph Locher

(57) ABSTRACT

An electric switching device includes first and second switch contact pieces. The first switch contact piece has a guide portion. The first switch contact piece is connected to an actuating unit or drive device by a kinematic chain. The guide portion of the first switch contact piece is guided on a guide path. The guide portion and the guide path each have a contact or bearing surface and at least one of the contact or bearing surfaces is convexly curved.

7 Claims, 10 Drawing Sheets

(51) Int. Cl.

| | |
|---|---|
| ***H01H 21/36*** | (2006.01) |
| *H01H 3/42* | (2006.01) |
| *H01H 33/70* | (2006.01) |
| *H01H 33/02* | (2006.01) |
| *H01H 33/666* | (2006.01) |

(52) U.S. Cl.
CPC *H01H 2033/028* (2013.01); *H01H 2033/6667* (2013.01); *H01H 2203/024* (2013.01)

(56) References Cited

U.S. PATENT DOCUMENTS

| | | | | |
|---|---|---|---|---|
| 5,578,806 | A | | 11/1996 | Hofbauer et al. |
| 5,743,987 | A | * | 4/1998 | Tang ..... B29C 47/0019 156/244.11 |
| 6,271,494 | B1 | | 8/2001 | Dienemann et al. |
| 6,365,863 | B1 | | 4/2002 | Marin et al. |
| 6,727,453 | B2 | | 4/2004 | Skarby et al. |
| 2001/0025827 | A1 | | 10/2001 | Hunger et al. |
| 2007/0272659 | A1 | | 11/2007 | Saxl et al. |
| 2007/0278186 | A1 | | 12/2007 | Capitanio et al. |

FOREIGN PATENT DOCUMENTS

| | | | |
|---|---|---|---|
| DE | 19727850 | C1 | 9/1998 |
| DE | 19738697 | C1 | 11/1998 |
| DE | 10006167 | B4 | 7/2009 |
| EP | 0696040 | A1 | 2/1996 |
| EP | 1310970 | A1 | 5/2003 |
| EP | 1939903 | A1 | 7/2008 |
| FR | 2491675 | A1 | 4/1982 |
| RU | 2376670 | C2 | 12/2009 |

* cited by examiner

ELECTRICAL SWITCHING DEVICE

BACKGROUND OF THE INVENTION

Field of the Invention

The invention relates to an electrical switching device having a first switch contact piece, which comprises a guide portion, and a second switch contact piece, wherein at least the first switch contact piece is connected to an actuating unit by way of a kinematic linkage for the purpose of generating a relative movement of the switch contact pieces with respect to one another and its guide portion is guided in a displaceable manner along a guide path.

An electrical switching device of this type is known by way of example from the printed patent specification DE 197 27 850 C1. Said specification describes a high voltage power switch having two switch contact pieces that can be actuated in opposite directions, wherein said switch contact pieces are described as arcing contact pieces. A kinematic linkage is provided for the purpose of actuating a first switch contact piece and said kinematic linkage connects the first switch contact piece to an actuating unit. The first switch contact piece is equipped with a guide portion that is guided on a guide path. The guide path and also the guide portion are tailored to match one another in such a manner that the switch contact piece can perform a linear movement in the direction of the guide path. The guide path is equipped for this purpose with a planar contact surface, wherein the guide portion is equipped with a planar contact surface that is embodied in a matching planar manner.

Although this manner of guiding the first switch contact piece renders it possible to guide the first switch contact piece in an exact manner, a construction of this type does, however, require precise manufacturing methods in order to prevent the guide portion from tilting in the guide path. However, even when the guide path and the guide portion are manufactured in a precise manner, abrasion occurs over a longer period of use. Consequently, the coefficient of friction between the guide portion and the guide path deteriorates as a result of which jamming can occur. This type of jamming is however to be prevented as far as possible. In order to ensure that an electrical switching device retains its functionability even after a longer period of operation, an actuation force is therefore coupled in by way of the kinematic linkage and said actuation force renders possible a switching movement between the guide portion and the guide path even in the case of increased friction resistance following a multiplicity of switching procedures. This results in over-dimensioned actuating units being used.

However, an increase in size of the actuating unit is economically only expedient up to a particular point. In particular, when using electrical switching devices in the high voltage and extra-high voltage range, the moved masses increase so that an over-dimensioned actuating unit causes disproportionate costs.

BRIEF SUMMARY OF THE INVENTION

Accordingly, the object of the invention is to provide an electrical switching device that can be equipped with a less powerful actuating unit.

The object is achieved in accordance with the invention in the case of an electrical switching device of the type mentioned in the introduction by virtue of the fact that the guide portion and the guide path are part of a rotate and slide joint that is connected to the kinematic linkage.

A rotate and slide joint renders it possible to superimpose a rotary movement on a slide movement. It is thus possible by way of example to displace the first switch contact piece in a linear direction, wherein a rotary movement, in particular of the first switch contact piece, is superimposed on this linear movement. As a consequence, the first switch contact piece can perform a linear movement, wherein the switch contact piece can perform in addition a pivot movement. Consequently, the guide portion cannot easily tilt on the guide path. It is possible by means of superimposing a rotary movement by way of example to compensate for any tolerances between the guide path and the guide portion so that it is ensured that the first contact piece is guided in a preferably almost linear straight line, wherein a rotatory movement that is performed relative to the slide path allows a clearance between the guide path and the guide portion. On the one hand, it is thus possible to guide the first switch contact piece in a defined manner. On the other hand, a rotary movement can prevent the switch contact piece from tilting. The rotate and slide joint can be embodied in such a manner that a rotary movement about an axis of rotation is possible, said axis of rotation being arranged essentially in a transverse manner with respect to the slide direction. In an advantageous manner, the slide direction should extend in an essentially linear manner along an axis and the axis of rotation should be different from the axis of the linear movement. The axis of rotation can extend by way of example in a transverse manner with respect to the slide axis (e.g. in an oblique or intersecting manner). The axis of rotation should preferably intersect the slide direction in an essentially perpendicular manner or rather lie in one plane of projection preferably in an essentially perpendicular manner with respect to the slide direction.

The invention can be used by way of example in the case of electrical switching devices that comprise a first and a second switch contact piece, wherein the first switch contact piece and the second switch contact piece can be moved relative to one another. It is possible to provide that only the first switch contact piece can be moved, wherein the second switch contact piece remains stationary. However, it can also be provided that during a switching movement the two switch contact pieces are subjected to a movement so that it is possible to increase the rate at which the contact is separated or rather the rate at which the contact is made. For this purpose, the two switch contact pieces are moved in the case of a starting procedure in each case towards the other switch contact piece and in the case of a shut-down procedure the switch contact pieces are moved in each case away from the other switch contact piece. In a particularly advantageous manner, the two switch contact pieces can be mounted in a linear displaceable manner, wherein they are arranged lying opposite one another and in a coaxial manner with respect to one another. Consequently it is possible to displace the two switch contact pieces along the coaxial axis, wherein in the case of a starting procedure and in the case of a shut-down procedure the movements of the first switch contact piece and the second switch contact piece are performed in opposite directions with respect to one another.

Naturally, a construction in accordance with the invention can also be used if only the first switch contact piece is arranged in a displaceable manner for the purpose of generating a relative movement of the switch contact pieces with respect to one another. Accordingly, the second switch contact piece that is mounted in a fixed manner can be arranged opposite the first switch contact piece, wherein the two switch contact pieces can be arranged in a coaxial manner with respect to one another.

The guide portion should be of a shape that is different to that of a shaft of the first switch contact piece. The guide portion should be thicker than the shaft. The guide portion can by way of example be essentially of a cylindrical shape, wherein its cylinder axis can lie in a transverse manner with respect to the linear displacement axis of the first switch contact piece. The shaft should preferably be embodied in a cylindrical manner, wherein the cylinder axis of the shaft lies in a transverse manner with respect to the cylinder axis of the guide portion essentially parallel to the slide axis. In particular, the cylinder axes lie in an essentially perpendicular manner with respect to one another and advantageously intersect one another. The guide path is used to guide the guide portion in order to move the first switch contact piece towards the second switch contact piece or rather away from said second switch contact piece during a switching process. The guide path determines and defines the slide direction of the first switch contact piece. A guide path can be embodied in different ways. A guide path can thus determine the slide direction of the first switch contact piece from the cooperation of multiple elements. A guide path can be embodied by way of example as a groove, a slot, a body edge, a shaft, an axle, a bushing, a cut-out etc. The guide path and the guide portion can be in direct or indirect contact.

In an advantageous manner, it can be provided that the first switch contact piece comprises a pin-shaped contacting portion and the second switch contact piece comprises a matching contacting portion that is shaped in the form of a tulip. In one embodiment, the reverse design is also provided. In addition, other shapes of the switch contact pieces or rather of their contacting portions are also possible. On the first switch contact piece, the contacting portion should be arranged on the shaft or rather the shaft should be used as the contacting portion.

In an advantageous manner, the two switch contact pieces should be embodied as arcing contact pieces of the electrical switching device. Arcing contact pieces have the characteristic that any shut-down arcing that occurs during a shut-down procedure is controlled at the arcing contact pieces. Any pre-arcing effects that occur during a starting procedure are likewise controlled preferably at the arcing contact pieces. It is possible to provide that in addition to their function as arcing contact pieces the switch contact pieces also perform the function of a nominal current contact piece. The invention can however also be used for contact pieces that are used both for nominal current guidance and also for electric arc guidance.

When using the invention on a switching device for high and extra-high voltages, it is advantageous if its functions of electric arc guidance and nominal current guidance are separated. In this case, the two switch contact pieces are allocated in each case a nominal current contact piece, wherein during a starting procedure the switch contact pieces contact one another before the respective allocated nominal current contact pieces and during a shut-down procedure the switch contact pieces are separated after the nominal current contact pieces have been separated. Accordingly, it is ensured that a switchable current path of the electrical switching device is embodied during a starting procedure initially between the switch contact pieces so that it is possible during a subsequent contacting of the nominal current contact pieces for a current to be commutated in a desired arc-free manner to the parallel connected nominal current contact piece. During a shut-down procedure, the nominal current contact pieces initially separate. During a shut-down procedure, it is ensured that as the nominal current contact pieces are separated the switch contact pieces continue to be in galvanic contact so that a current from the nominal current contact pieces can be commutated to the switching contact pieces in an as far as possible arc-free manner and any shut-down arcing that likewise occurs as the switch contact pieces separate is controlled at the switch contact pieces.

It can be provided that the nominal current contact pieces can be moved in each case so that the two nominal current contact pieces are moved relative to one another as a result of the movement of two nominal current contact pieces. However, it can also be provided that one of the nominal current contact pieces is embodied in such a manner that it is fixed and the other nominal current contact piece is embodied in such a manner that it can move. Accordingly, it is also possible to provide any user-defined combinations of switch contact pieces that are mounted so as to be movable or fixed in position and also nominal current contact pieces that are mounted so as to be movable or fixed in position.

In order to generate a movement of the first switch contact piece, it is possible to provide the use of an actuating unit. An actuating unit generates a movement that can be transmitted to one or multiple switch contact pieces. The actuating unit comprises by way of example an energy converter that converts by way of example electrical energy into kinetic energy. It is possible by way of a kinematic linkage to transmit a movement that is output by the actuating unit as far as the actuatable first switch contact piece. It is particularly advantageous if a common actuating unit is used for actuating multiple switch contact pieces or rather one/multiple nominal current contact pieces. As described above, a movement between the switch contact pieces and nominal current contact pieces can be performed in a defined procedure with respect to time. It is possible by means of a kinematic linkage on the one hand to bridge a spatial distance from the actuating unit as far as the switch contact piece/nominal current contact piece that is to be moved. On the other hand, it is possible by means of the kinematic linkage to modify the movement that is provided by the actuating unit. The kinematic linkage can comprise by way of example transmission systems that generate a time delay or similar so that different movements can be uncoupled at different sites of the kinematic linkage. However, it can also be provided that multiple kinematic linkages exist adjacent to one another at the electrical switching device and said kinematic linkages actuate the switch contact pieces or rather nominal current contact pieces that can move in different manners relative to one another.

By way of example, it is possible to provide that the second switch contact piece and/or a nominal current contact piece is connected to the actuating unit, wherein the second switch contact piece can be part of the kinematic linkage for actuating the first switching contact piece. The first switch contact piece can by way of example be coupled by way of an electrically insulating component to the second switch contact piece. The electrically insulating component is part of a kinematic linkage. The switching distance that lies between the two switch contact pieces thus renders it possible to transmit a movement in an electrically insulated manner from one potential side (second switch contact piece) to the other potential side (first switch contact piece) of the electrical switching device. Components that are at different electrical potentials from one another can be coupled in a mechanical manner to one another. Consequently, the kinematic linkage can convey through its progression electrical potentials that differ from one another. By way of example, it can be provided that the electrically insulating component is embodied in the form of a nozzle that is made from an insulating material and said nozzle surrounds the second switch contact piece and in the narrow portion of the nozzle that is made from an insulating material the switching distance extends at least in part between the two switch contact pieces. The switching distance is thus embodied on the one hand between the two (mutually separated) switch contact pieces. On the other hand, the spatial extension of the switching distance is defined by the nozzle that is made from an insulating material. The switching distance extends in a channel in the nozzle that is made from an insulating material, (said channel comprising the narrow portion of the nozzle that is made from an insulating material). Accordingly, it is possible during a switching movement to move the first switch contact piece into the nozzle that is made from an insulating material. The nozzle that is made from an insulating material can be coupled to an actuating element such as by way of example an actuating rod that can be displaced in a linear manner and couples a movement to the first switch contact piece by way of a transmission system that is part of the kinematic linkage. A transmission system that couples a movement that is transmitted by way of the nozzle that is made from an insulating material to the first switch contact piece can be used by way of example for the purpose of producing a reversal in the direction of movement of the movement that is transmitted by the nozzle that is made from an insulating material so that the first switch contact piece and the second switch contact piece can be moved automatically in each case in the opposite direction, by way of example in relation to a longitudinal axis of the electrical switching device. Consequently, it is possible using a common actuating unit to move the two switch contact pieces in opposite directions with respect to one another and thus, in comparison to a system where only one switch contact piece is driven, to increase the contact separation speed or rather the contacting speed of the switching device.

The electrical switching device can comprise an encapsulating housing and the switch contact pieces are arranged in said housing. Accordingly, the inside of the encapsulating housing can be filled with an electrically insulating fluid, by way of example an insulating gas or insulating oil. The housing limits the escape of the electrically insulating fluid and can hermetically seal-in the fluid so that said fluid can also be highly pressurized. $SF_6$ is suitable as an insulating gas. The switching distance between the switch contact pieces is filled with the electrically insulating fluid. In the case of arcing that occurs during a switching procedure, fluid that is located in the switching distance can vaporize or the pressure be increased so that by way of example a plasma is produced that can assist in extinguishing a switching arc. For this purpose, the fluid/plasma that is subjected to an increased pressure is set in a flow motion so that the switching arc can be disrupted.

In an advantageous manner, it can be provided that the guide portion comprises a contact surface that lies against the guide path and the guide path comprises a contact surface that lies against the guide portion, wherein at least one of the contact surfaces is curved in a convex manner.

In order to produce a rotate and slide joint, it is possible to provide that the guide portion and the guide path comprise in each case contact surfaces, wherein at least one of the contact surfaces is curved in a convex manner. The convex curvature can be produced in such a manner that the curvature extends about multiple spatial axes so that by way of example a contact surface is produced in the form of a convex curved spherical cap. However, it is also possible to provide that only one axis of curvature is provided for the purpose of producing a convex contact surface so that said convex contact surface is produced by way of example in the manner of a portion of a peripheral surface of a circular cylinder. In addition, the convex curved contact surface can also be embodied in a different manner to that of a circular cylinder peripheral surface or the surface of a sphere so that any user-defined spatially curved contact surface of a convex type can be produced.

The use of a convex curved contact surface renders it possible to form a spot-shaped or linear-shaped contact region between the contact surfaces of the guide path and the guide portion. Consequently, compensating movements between the contact surfaces of the guide path or rather the guide portion are possible in a simpler manner. Thus, the convex curved contact surface on the other contact surface during a relative movement between the guide path and the guide portion can allow the guide path and the guide portion to tilt and pivot with respect to one another so that by way of example any clearance that occurs between the guide path and the guide portion as a result of abrasion or manufacturing tolerances can be compensated for. It is thus possible to reduce the friction losses between the contact surfaces. Consequently, it is possible to use a less powerful actuating unit. It is also possible to provide that both a contact surface of the guide path and also a contact surface of the guide portion can be curved in a convex manner. It is further possible to provide that the guide path comprises at least two contact surfaces that are arranged in opposite directions and are embodied in particular in a planar manner, wherein the guide portion contacts two contact surfaces of the guide path so that a transverse movement or rather a raising and lowering movement of the guide portion out of the guide path is prevented. For this purpose, the guide portion can also comprise multiple contact surfaces that ensure together a guiding arrangement along the guide path. A linear guide by means of the guide path can also be ensured by using multiple convex shaped contact surfaces of the guide path, wherein the loading is removed from the multiple convex shaped contact surfaces in procedure one after the other. In addition, the guide path can comprise by way of example also a curved path progression so that the guide path itself comprises at least one contact surface that is curved in a convex manner and can then in turn by way of example also be contacted by a planar contact surface of the guide portion. Also in the case of a design of this type, the contact region between the guide path and the contact surface can be embodied in a spot-shaped or rather linear-shaped manner so that the guide portion cannot easily tilt on the guide path.

In addition, a convex shape of contact surfaces of the guide path and the guide portion can also be provided. In this case, the possibilities are improved for guiding the slide track along the guide path of almost any path progression.

Furthermore, it is possible in an advantageous manner to provide that one of the contact surfaces is embodied in a planar manner.

In an advantageous manner, the guide path and also the guide portion can be designed so as to steer or rather guide a linear movement of the switch contact piece. By way of example, the guide path can comprise a linear extended progression so that the guide portion is guided contacting the guide path along the guide path. The guide path can comprise for this purpose by way of example at least one planar contact surface that is arranged in parallel with respect to the axis of movement of the first switch contact piece. Accordingly, the guide portion can be embodied with a convex contact surface that slides by way of example on the planar contact surface along the guide path. Accordingly a linear or spot-shaped contact region is formed between the guide path and the guide portion and said contact region performs the guiding arrangement and transmits force between the guide path and the guide portion. The guide path can by way of example comprise two planar contact surfaces that are arranged in opposite directions and are both contacted simultaneously by means of the guide portion. Thus, the two contact surfaces ensure that the guide portion is released from the guide path. A contact surface of a guide path can by way of example be embodied as a groove base of a groove. A groove of this type can be embodied assembled from more than one part, it is thus possible to arrange by way of example groove flanks and the groove base on different part elements. It is possible in a particularly advantageous manner for a groove to be assembled from half shells that are preferably shaped in a matching manner. A half shell can comprise in each case a groove flank and a part of the groove base. As the half shells are joined together, the groove base is completed and a joining gap is arranged in the groove base. The joining gap can be designed more or less wide as required. A multi-part design of a groove facilitates the process of assembling the electrical switching device. Thus, the groove flanks render it possible to provide additional stabilization of the guide portion that protrudes into the groove. It is also possible in this case for the convex contact surfaces of the guide portion to extend inwards or rather the groove flanks can be provided with a convex profile. Accordingly, the guide portion can comprise two convex contact surfaces of which in each case one contact surface cooperates with one of the contact surfaces of the guide path. The contact surfaces of the guide portion can in each case be curved in a convex manner, wherein the contact surfaces are arranged (curved) in an opposite manner with respect to one another.

A further advantageous embodiment can be provided in that the first switch contact piece comprises a slot and an entraining element of the kinematic linkage engages in said slot, wherein the entraining element comprises a planar contact surface that lies against a flank of the slot.

A slot comprises at least one shoulder and the entraining element can engage in said shoulder or rather the entraining element can contact said shoulder. A shoulder of this type is by way of example a flange of a groove or rather a through-going cut-out or also a flank of a shoulder that is raised from a surface. The shape of the slot with respect to its flank that is to be contacted renders possible a relative movement between the entraining element and the slot or rather the first switch contact piece. It is thus possible by way of example by way of the entraining element of the kinematic linkage to transmit an actuating movement onto the first switch contact piece. Depending upon the type of movement of the entraining element and also the shape of the slot, it is possible to transmit different movement patterns to the switch contact piece. By way of example, the slot can be embodied in the form of a linear elongated hole and an entraining element in the form of a pin can engage in said linear elongated hole. The pin renders it possible for a corresponding movement to be transmitted to the slot or rather to the first switch contact piece, so that by way of example a movement on the second switch contact piece can be transmitted to or from the second switch contact piece. The entraining element can by way of example transmit a pivot movement, a linear movement, a pulling or pushing movement to a flank of the slot so that a corresponding movement is performed when the first contact piece is mounted in such a manner that it can move. By way of example, the slot can be embodied in the manner of an elongated hole that extends essentially in a transverse manner with respect to the axis of movement of a linear displaceable first switch contact piece. It is preferred that the slot can be arranged in the region of the guide portion of the first switch contact piece. Consequently, a force can be introduced for the purpose of moving the first switch contact piece in the region of the guide portion, wherein the first switch contact piece is guided in the guide portion on the guide path. Furthermore, a mechanically robust construction is produced by virtue of the fact that an actuating movement is coupled in this manner into the first switch contact piece.

Furthermore, a planar contact surface of the entraining element on the flank of the slot renders it possible to increase the region that is available in the region of the slot for the purpose of introducing the force. Usually, the space that is available on the switch contact piece is limited, wherein it is advantageous to use the planar contact surface for the purpose of transmitting greater actuating forces and for avoiding compressions/expansions on the switch contact piece. Actuating forces can be transmitted by way of enlarged surfaces so that deformation of the slot or rather the entraining element is prevented. It is possible to use sophisticated constructions for the embodiment of the slot and entraining element, said constructions comprising by way of example a pin that is guided inside the slot, wherein the pin preferably comprises on the peripheral face a corresponding planar contact surface that is guided on the flank of the slot. By way of example, it is possible to provide that the contact surface of the entraining element is embodied in a planar manner, whereas the flank of the slot is embodied in a convex but preferably likewise matching planar manner. In particular, in the case of a linear embodiment of the elongated hole, it is possible in a simple manner to provide planar contact surfaces between the entraining element and the slot flank.

A further advantageous embodiment can provide that the first switch contact piece comprises a slot and an entraining element of the kinematic linkage engages in said slot, wherein the entraining element comprises a spherically curved surface that is guided in the slot.

The entraining element having a spherically curved surface can by way of example be a spherically curved surface portion of a sphere that is guided by way of example in a slot that is formed as a groove. This surface portion can contact the groove flanks of the slot so that a force can be transmitted between the entraining element and the slot. It is preferred that the slot can be embodied by way of example in the form of a groove that has a groove cross section that is embodied in a matching manner with respect to the spherically curved surface of the entraining element. Consequently, the contact region that is available for transmitting forces between the slot and the entraining element is increased. By virtue of the enlarged region that is available for transmitting forces between the entraining element and the slot, it is possible to increase the stability of the slot and the entraining element. Thus, it is possible by way of example that a cylindrical pin engages in the slot, wherein a free end is rounded in a spherical shape, so that this spherically rounded end is guided in the slot. The slot can contact the spherically rounded surface of the entraining element and use said surface for the purpose of transmitting force. In addition, it is naturally also possible to use a peripheral surface of a pin for the purpose of transmitting force. Accordingly, expansion or rather abrasion of the slot is impeded since the actuating forces are transmitted over larger contact surfaces.

A further advantageous embodiment can provide that the entraining element is mounted in a rotatable manner on an in particular pivotable actuating lever.

An actuating lever is used by way of example for converting a by way of example linear movement and is part of the kinematic linkage for the purpose of actuating the first switch contact piece. A pivotable actuating lever is mounted in such a manner that it can rotate about an axis, wherein an entraining element is mounted on a lever arm. By virtue of mounting the entraining element in the pivotable actuating lever in a rotatable manner, it is possible to provide the entraining element with a planar contact surface that engages on a planar flank of a slot. Consequently, it is possible to compensate for tilting, such as by way of example during excess lifting or rather as the entraining element rotates about the axis of rotation of the actuating lever. By way of example, it is possible, by virtue of mounting the entraining element on the actuating lever in a rotatable manner, for a planar contact surface of the entraining element to permanently maintain a position, by way of example perpendicular, vertical or any user-defined position, during a rotational movement of the lever.

A further advantageous embodiment can provide that the entraining element encompassed by an abrasion-proof bushing is mounted in a rotatable manner.

The entraining element encompassed by an abrasion-proof bushing can be mounted in a rotatable manner. The bushing can be connected on the one hand at a fixed angle to the entraining element so that a rotational movement is performed by virtue of the inter-positioning on a pivotable lever arm of a bushing that is fixed at a fixed angle to the entraining element. However, it is also possible to provide that the bushing is arranged at a fixed angle on the lever arm so that the entraining element is arranged in a rotatable manner inside the abrasion-proof bushing. By virtue of using a bushing, it is possible to use a cost-effective material for the lever arm, whereas an abrasion-proof material is used in the region of the bushing. Consequently, forces can be introduced into the lever arm in a simplified manner in particular in the region of the rotatably mounted actuating element or rather forces can be transmitted from said lever arm to the entraining element, wherein as a result of the bushing, the actuating lever is prevented from expanding or rather deforming.

A further advantageous embodiment can provide that at least one contact surface is provided with an abrasion-proof insert.

Irrespective of the shape of a contact surface, it is possible to provide that the contact surface comprises an insert that is embodied from an abrasion-proof material. Consequently, it is possible to increase the mechanical strength of the contact surface. Thus, it is possible by way of example to increase the mechanical strength of the guide path or of the guide portion. However, it is also possible to provide that a contact surface of the slot or of the corresponding entraining element that engages in the slot is provided with an abrasion-proof insert. Consequently, it is possible to use cost-effective materials, wherein it is only necessary to embody in an abrasion-proof manner those contact surfaces that are subjected to abrasion by means of moving parts. Furthermore, an embodiment of this type provides the advantage that it is possible by way of example to select a material for the first switch contact piece on the basis of the electrical characteristics of the material, wherein only those portions on the first switch contact piece that are subjected to increased mechanical loadings as a result of the introduction of actuating forces are to be provided with correspondingly abrasion-proof inserts. Consequently, it is possible to embody the composite body in a cost-effective mechanically robust manner.

BRIEF DESCRIPTION OF THE SEVERAL VIEWS OF THE DRAWING

An exemplary embodiment of the invention is illustrated schematically herein below in a drawing and further described herein below.

In the drawing.

DESCRIPTION OF THE INVENTION

Details of the constructions illustrated in FIGS. 1 to 12 that differ from one another and have an identical function can be combined with one another or rather interchanged.

Figure 1:
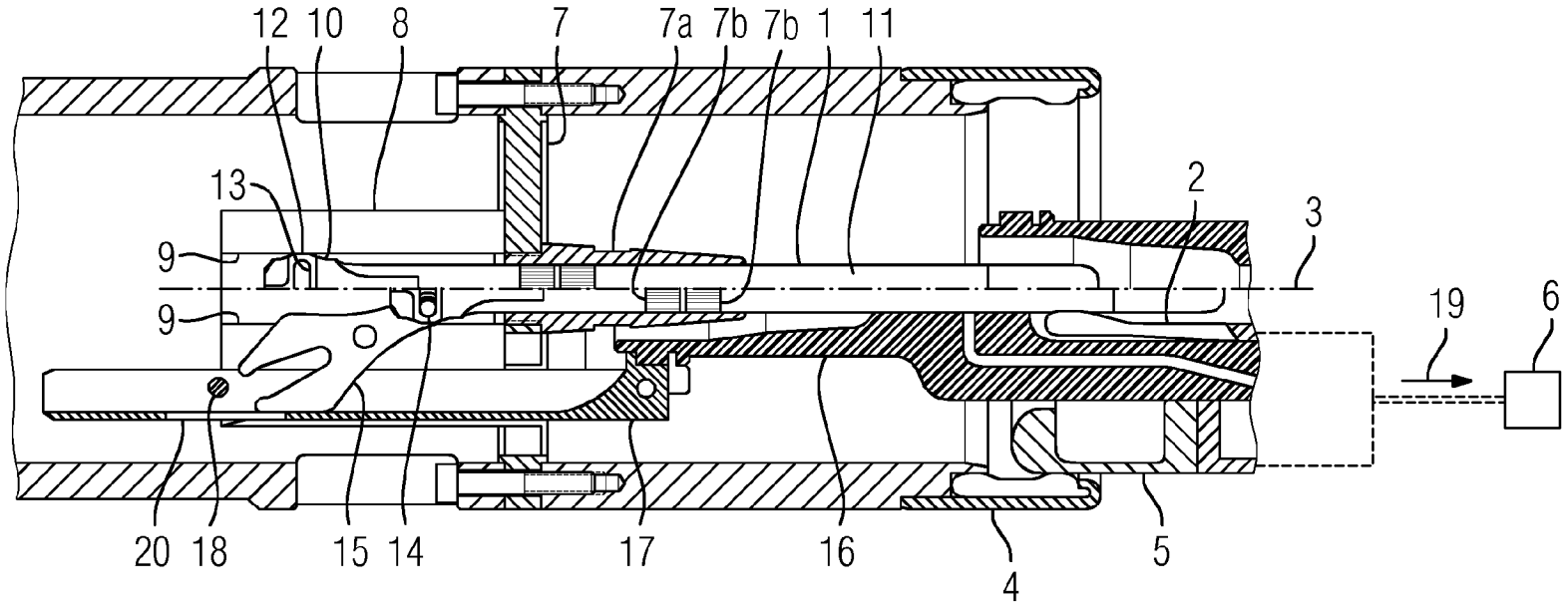
FIG. 1 illustrates a section through an electrical switching device.

FIG. 1 illustrates a section through an electrical switching device. The electrical switching device comprises a first switch contact piece 1 and a second switch contact piece 2. The first switch contact piece 1 and also the second switch contact piece 2 are arranged opposite one another at the end face, wherein the two switch contact pieces 1, 2 are arranged in a coaxial manner with respect to a main axis 3. FIG. 1 illustrates the electrical switching device in such a manner that above the main axis 3 the assemblies that can move relative to one another are illustrated in a shut-down position of the electrical switching device and below the main axis 3 the components that can move relative to one another are illustrated in the starting position of the electrical switching device. In the starting position, the switch contact pieces 1, 2 contact one another, in the shut-down position the switch contact pieces 1, 2 are separate from one another.

The first switch contact piece 1 comprises a pin-shaped contacting region that has a circular cross section and is arranged in a coaxial manner with respect to the main axis 3. The second switch contact piece 2 is arranged opposite at the end face, wherein the second switch contact piece 2 comprises a tulip-shaped contacting region. The second switch contact piece 2 is essentially tubular in shape. In the starting state (below the main axis 3), the first switch contact piece 1 is inserted into the second switch contact piece 2. A galvanic connection is produced between the two switch contact pieces 1, 2. Both the first switch contact piece 1 and also the second switch contact piece 2 can be moved by way of an actuating unit 6. The two switch contact pieces 1, 2 function as arcing contact pieces in the case of the electrical switching device as shown in FIG. 1. Accordingly, a first nominal current contact piece 4 is allocated to the first switch contact piece 1 and a second nominal current contact piece 5 is allocated to the second switch contact piece 2. The first nominal current contact piece 4 is arranged in a fixed manner. Accordingly, both above the main axis 3 and also below the main axis 3 it is not possible to discern a change in position of the first nominal current contact piece 4. The second nominal current contact piece 5 can be displaced along the main axis 3 by way of the actuating unit 6. The second nominal current contact piece 5 is essentially tubular in shape, wherein in the starting state the first nominal current contact piece 6 lies on the outer peripheral face on the second nominal current contact piece 5 with movable contact elements. The second nominal current contact piece 5 is arranged in a coaxial manner with respect to the main axis 3, wherein the second nominal current contact piece 5 encompasses the second switch contact piece 2. The second switch contact piece 2 and the second nominal current contact piece 5 always have an identical electrical potential. The nominal current contact pieces 4, 5 and the switch contact pieces 1, 2 illustrated in FIG. 1 are surrounded by a pressurized electrically insulating fluid, in particular a gas, that is enclosed within an encapsulating housing (not illustrated).

The first nominal current contact piece 4 is essentially tubular in shape and is arranged in a coaxial manner with respect to the main axis 3. The first nominal current contact piece 4 encompasses the first switch contact piece 1 on the outer peripheral face. A supporting device 7 is arranged on the first nominal current contact piece 4. The first switch contact piece 1 is positioned within the first nominal current contact piece 4 by way of the supporting device 7 and mounted in a displaceable manner with respect to the first nominal current contact piece 4. The supporting device 7 is embodied in an electrically conductive manner so that the first nominal current contact piece 4 and the first switch contact piece 1 are permanently in electrical contact with one another. Accordingly, in one guide sleeve 7*a* of the supporting device 7, sliding contact arrangements 7*b* are arranged on the first switch contact piece 1. The sliding contact arrangements 7*b* slide inside the guide sleeve 7*a* and provide contact between the guide sleeve 7*a* and the first switch contact piece 1.

Furthermore, a transmission system carrier 8 is arranged on the supporting device 7. The transmission system carrier 8 comprises a guide path 9. The guide path 9 comprises a predominantly planar contact surface, wherein the guide path 9 is arranged in parallel with respect to the main axis 3. In this case, the guide path 9 comprises two similar contact surfaces that are arranged opposite to one another in a mirror-symmetrical manner with respect to the main axis 3 and a guide portion 10 of the first switch contact piece 1 is guided inside said contact surfaces. The contact surfaces of the guide path 9 are embodied in each case as a groove base of a U-shaped profiled groove. The U-shaped grooves are arranged opposite to one another. The groove openings are facing one another. The grooves are arranged in parallel with respect to the main axis 3. The grooves are assembled from matching half shells, wherein a joining gap remains at least in one of the groove bases and said joining gap is dimensioned of such a width that a two-armed actuating lever 15 can pass through said joining gap. The contact surfaces of the guide path 9 are divided into two in the longitudinal axis by means of the respective joining gap.

The guide portion 10 of the first switch contact piece 1 is thicker (has a greater extension) in the radial direction (in a transverse manner with respect to the main axis 3) than a shaft 11 of the first switch contact piece 1. The shaft 11 has in this case a circular cylindrical cross section and comprises the contacting region, whereas the guide portion 10 has an essentially cylindrical shape, wherein its cylindrical axis is arranged in a perpendicular manner with respect to the main axis 3. The cylinder axis of the shaft 11 is arranged in parallel, in particular congruent, with respect to the main axis 3. The cylinder axes of the shaft 11 and the guide portion 10 lie at right angles with respect to one another. The guide portion 10 comprises two contact surfaces 12 that lie in each case against a contact surface of the guide path 9.

The contact surfaces 12 are in this case curved in a convex manner, wherein the axis of curvature is arranged essentially in a perpendicular manner with respect to the main axis 3. Accordingly, the convex curved contact surfaces 12 of the guide portion 10 are arranged in each case in a curved manner about a single axis (in this case the same axis). It is preferred that the contact surfaces 12 can be portions of a peripheral surface of a circular cylinder. A cylinder axis of this circular cylinder can preferably be arranged in such a manner that it intersects the main axis 3. As an alternative thereto, however, it is also possible to provide that the contact surfaces 12 of the guide portion 10 are embodied by way of example in each case in the shape of a surface that is curved about multiple axes. Thus, it is possible for a contact surface 12 by way of example to be in the shape of a spherical cap.

The guide portion 10 comprises in each case a contacting portion opposite each of the two contact surfaces of the guide path 9, said contacting portion being embodied in a linear manner. The friction between the contact surfaces of the guide path 9 and the contact surfaces 12 of the guide portion 10 is reduced by virtue of this linear-shaped design. It is preferred that the contact surfaces 12 of the guide portion 10 should be parts of a circular cylindrical peripheral surface, wherein the cylinder axis extends through the main axis 3.

The guide path 9 comprises grooves and the groove bases of said grooves form in each case a contact surface. Thus, it is possible to displace the first switch contact piece 1 in an axial manner in the direction of the main axis 3. The groove flanks of the groove ensure that the contact surfaces 12 of the guide portion 10 are positioned in the guide path 9. In a similar manner to the matching embodiment of two contact surfaces of the guide path 9, said contact surfaces being arranged opposite one another, the guide portion 10 is embodied in a mirror-symmetrical manner with respect to the main axis 3 so that the guide path 9 guides the first switch contact piece 1 in a linear manner in the direction of the main axis 3, wherein as a result of the convex shape of the contact surfaces 12 of the guide portion 10 the guide portion 10 is prevented from tilting on the guide path 9. Consequently, the guide portion 10 can be displaced in a linear manner in the direction of the main axis 3, wherein a resulting rotational movement is allowed during the course of a linear displacement of the first switch contact piece 1 in the guide path 9.

A movement that is output by the actuating unit 6 is transmitted by way of a kinematic linkage to the first switch contact piece 1. A slot 13 is provided in the first switch contact piece 1 for the purpose of actuating the first switch contact piece 1. The slot 13 is arranged in the cylindrical guide portion 10 of the first switch contact piece 1. The slot 13 is a through-going elongated hole that comprises a linear path progression, wherein a longitudinal extension runs in a transverse manner in particular in a perpendicular manner with respect to the main axis 3. An entraining element 14 engages in the slot 13. The entraining element 14 in this case is embodied as a pin that is mounted on a first lever arm of a two-armed actuating lever 15. The two-armed actuating lever 15 is mounted on the transmission system carrier 8 and consequently on the first nominal current contact piece 4. The second lever arm of the two-armed actuating lever 15 is embodied in the form of a fork. As the lever arm pivots, starting from the starting position (below the main axis 3) in an anti-clockwise direction, the entraining element 14 that is arranged on the first lever arm pivots, wherein the entraining element 14 slides through the slot 13 and, sliding along a flank of the slot 13 converts the pivot movement of the two-armed actuating lever 15 into a linear movement of the first switch contact piece 1 that comprises the slot 13. The starting position of the first switch contact piece 1 is abandoned and a switched-off position of the first switch contact piece 1 (above the main axis 3) is assumed.

The two-armed actuating lever 15 is part of a kinematic linkage in order to transmit an actuating movement from the actuating unit 6 to the first switch contact piece 1.

The actuating unit 6 is connected to the second switch contact piece 2 and also to the second nominal current contact piece 5. The second switch contact piece 2 and also the second nominal current contact piece 5 are mounted in such a manner so as not to be able to move relative to one another. A movement of the first nominal current contact piece 5 thus leads automatically to a movement of the second switch contact piece 2 and conversely. The second nominal current contact piece 5 is connected at a fixed angle to a nozzle 16 that is made from an insulating material. As a result of the coupling at a fixed angle of the second nominal current contact piece 5 to the second switch contact piece 2, the nozzle 16 that is made from an insulating material is also connected at a fixed angle to the second switch contact piece 2. Accordingly, during a movement of the second switch contact piece 2 and also of the second nominal current contact piece 5, the nozzle 16 that is made from an insulating material moves simultaneously with said pieces. Both the second switch contact piece 2 and also the second nominal current contact piece 5 and also the nozzle 16 that is made from an insulating material are mounted in such a manner that they can be displaced along the main axis 3. The nozzle 16 that is made from an insulating material is embodied as a rotationally symmetrical body that is made from an insulating material and comprises centrally a narrow portion of the nozzle that is made from an insulating material, wherein the narrow portion of nozzle that is made from an insulating material encompasses the switching distance that is formed between the two switch contact pieces 1, 2. The nozzle 16 that is made from an insulating material is arranged in such a manner that the nozzle 16 that is made from an insulating material is encompassed by the second nominal current contact piece 5 at least in portions on the outer peripheral face, wherein the nozzle 16 that is made from an insulating material encompasses the second switch contact piece 2 at least in portions. The nozzle 16 that is made from an insulating material covers the switching distance between the two switch contact pieces 1, 2.

The nozzle 16 that is made from an insulating material is connected on its end that is remote from the second switch contact piece 2 to an actuating rod 17. The actuating rod 17 is in this case formed as an essentially linear U-profile, wherein the linear profile progression of the actuating rod 17 is arranged in parallel with respect to the main axis 3. The actuating rod 17 is supported in such a manner that it can slide on the transmission system carrier 8, wherein a fork-shaped lever arm of the two-armed actuating lever 15 protrudes into the U-profile of the actuating rod 17. The fork ends of the fork-shaped lever arm are formed in such a manner that in the starting state or rather the switched-off state the two-armed actuating lever 15 abuts in each case with one of its fork ends against the base of the U-profile of the actuating rod 17 and is fixed in position. A sporadic movement of the first switch contact piece 1 is blocked by way of the entraining element 14 and the slot 13. An actuating pin 18 is arranged on the actuating rod 17 and said actuating pin is arranged in a transverse manner with respect to the main axis 3. The actuating pin 18 is held between the flanks of the U-profile of the actuating rod 17. It is possible by means of the actuating pin 18 for the fork-shaped end of the two-armed actuating lever 15 to be entrained during a linear movement of the actuating rod 17. Consequently, it is possible to transmit to the actuating pin 18 a linear movement that is transmitted to the second switch contact piece 2 or rather to the second nominal current contact piece 5 and consequently also to the nozzle 16 that is made from an insulating material and to the actuating rod 17. During a movement of the second switch contact piece 2 in the direction of the main axis 3, the actuating pin 18 enters the fork-shaped end of a lever arm of the two-armed actuating lever 15, as a consequence of which a linear movement is converted into a pivot movement of the two-armed actuating lever 15. In order to render it possible for the two-armed actuating lever 15 to pivot, a cut-out 20 is provided in the groove base of the actuating rod 17. By virtue of the cut-out 20, the fork ends of the two-armed actuating lever 15 can pivot out of their respective blocking position. As a result of the two-armed guiding arrangement of the two-armed actuating lever 15, it is possible in cooperation with the entraining element 14 and the slot 13 to produce at the first switch contact piece 1 a reversal in the sense of the direction of the movement of the second switch contact piece 2, in other words while the two switch contact pieces 1, 2 are moved in the same direction, namely along the main axis 3, this always occurs with a reversed sense of direction so that the two switch contact pieces 1, 2 are moved towards one another or away from one another.

Figure 2:
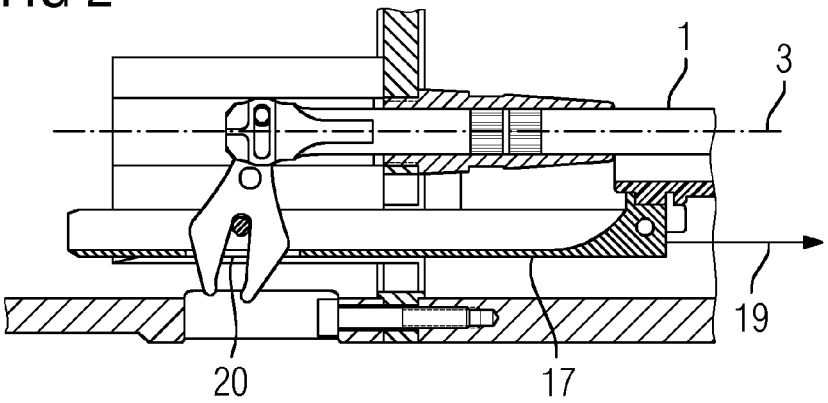
FIGS. 2 to 4 illustrate a progression of movement of a first switching piece during a shut-down procedure.
Figure 3:
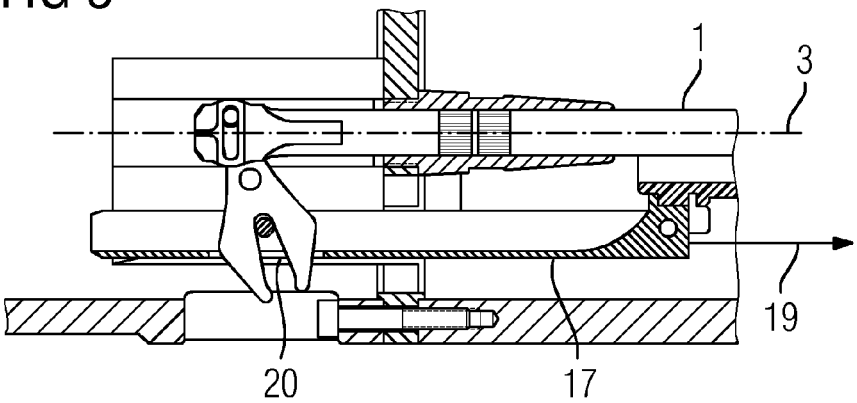
Figure 4:
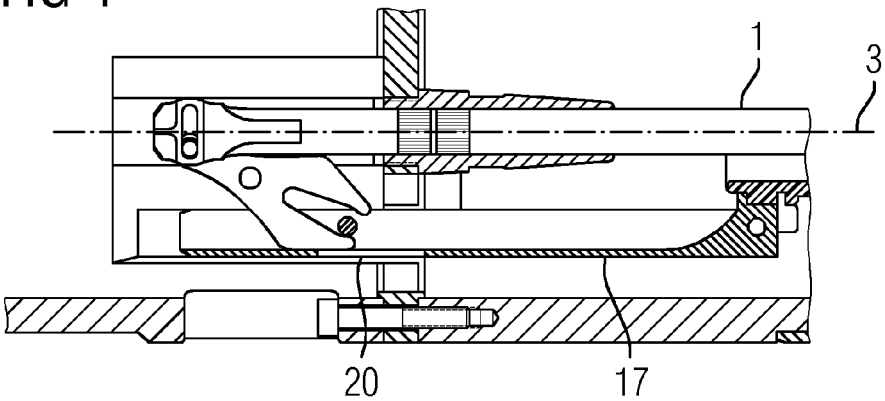

FIGS. 2, 3 and 4 describe a movement progression of the first switch contact piece 1 from its starting position (FIG. 1 below the main axis 3) into its switched-off position (FIG. 4 and FIG. 1 above the main axis 3). For a switching-off movement, a continued movement of the second nominal current contact piece 5 is initiated by the actuating unit 6 and also a continued movement of the second switch contact piece 2 is initiated by the first switch contact piece 1 or rather the first nominal current contact piece 4. The galvanic contact between the two nominal current contact pieces 4, 5 and the two switch contact pieces 1, 2 is to be eliminated as a consequence. The direction of the switching-off movement of the actuating unit 6 is indicated in FIG. 1 by the arrow 19. The nozzle 16 that is made from an insulating material and is connected at a fixed angle to the second switch contact piece 2 and also to the second nominal current contact piece 5 is entrained during a movement in the direction of the arrow 19. Accordingly, the actuating rod 17 and the actuating pin 18 that is fastened thereto are also entrained. The actuating pin 18 enters the fork-shaped end of the two-armed actuating lever 15 and causes the two-armed actuating lever 15 to pivot in an anti-clockwise manner. The cut-out 20 is provided in the base region of the U-shaped profile of the actuating rod 17 and the fork-shaped end of the two-armed actuating lever 15 can pass through said cut-out during a pivot movement. The axial extension of the cut-out 20 is dimensioned in the groove region of the actuating rod 17 in such a manner that the position of the pivot lever is always ensured even while the pivot lever pivots from its starting position into its switched-off position, in other words the position of the two-armed actuating lever 15 is fixed even while switching from a starting position into a switched-off position (and conversely) so that the position of the first switch contact piece 1 is defined by way of the coupling to the second switch contact piece 2 and a sporadic displacement of the first switch contact piece 1 is not possible.

During the pivot movement of the two-armed actuating lever 15, the entraining element 14 likewise pivots in an anti-clockwise direction, wherein the movement of the entraining element 14 is transmitted to the slot 13 of the first switch contact piece 1 and the pivot movement is in turn converted into a linear movement. As a result of the embodiment and the coupling of the two-armed actuating lever 15, the sense of direction of the actuating movement is reversed, which, transmitted from the second nominal current contact piece 5 or rather from the second switch contact piece 2, causes the electrical switching device to be switched.

At the end of a switching-off movement in the switched-off position (FIG. 4; and also FIG. 1 above the main axis 3), the fork-shaped end of the two-armed actuating lever 15 is in turn secured in the groove base of the actuating rod 17 prior to an outwards pivot movement. A starting procedure is performed in the reverse sequence.

The fundamental function of the electrical switching device and also of the effect of the first switch contact piece 1 and also the kinematic linkage are described in FIGS. 1 to 4. With regard to the illustrations in FIGS. 5, 6, 7, 7A, 8, 8A, 8B, 9, 9A, 10, 10A, 11, 11A, 12 and 12A only possibilities of the embodiment of the guide portion 10 of the entraining element 14 and furthermore elements that are located in this region are to be described in detail.

Figure 5:
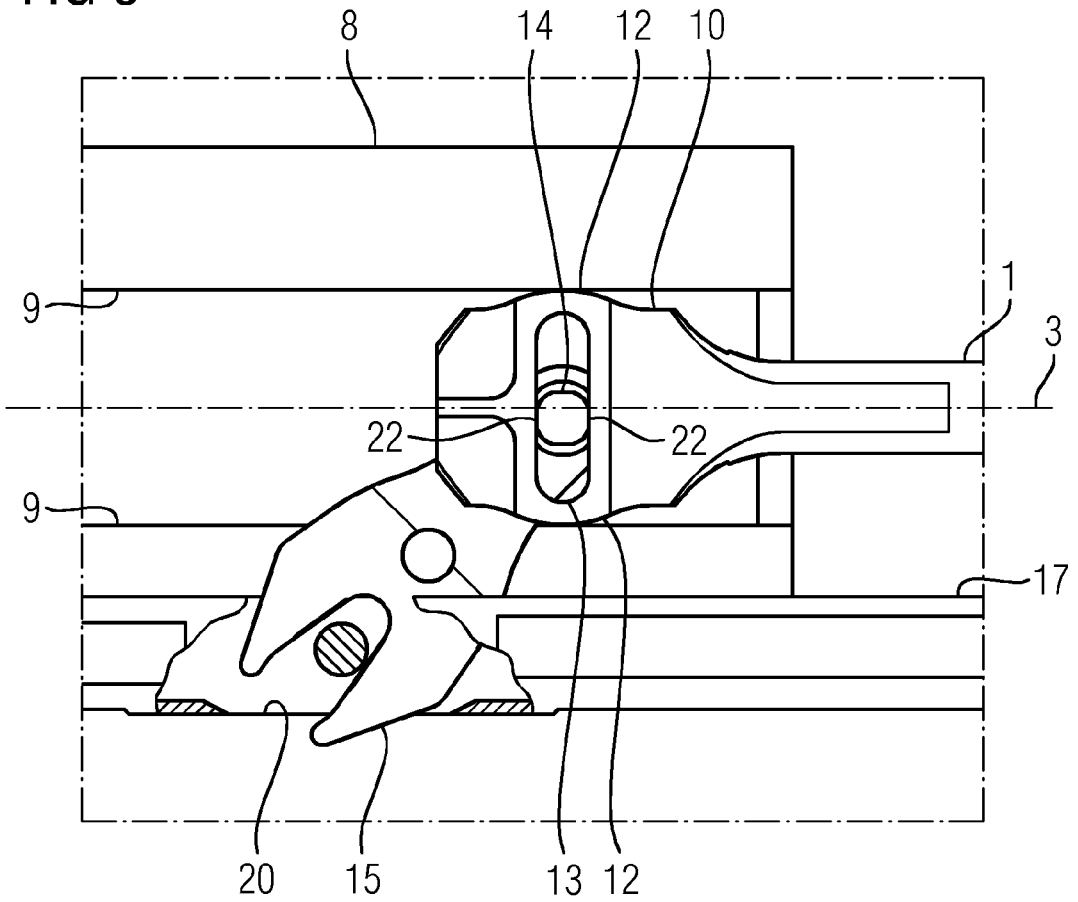
FIG. 5 illustrates a detail of a guide portion of the first switch contact piece.

FIG. 5 illustrates the guide portion 10 of the first switch contact piece 1, wherein the guide portion 10 is provided with convex contact surfaces 12. The convex contact surfaces 12 are in each case part of a periphery of a cylinder that has a circular cross section. The circular cross section is symbolized in the figure by means of the broken line. The axis of curvature of the contact surfaces 12 extends through the main axis 3. Furthermore, it is evident that the guide path 9 comprises two contact surfaces that are arranged in opposite directions and are embodied in each case in a planar manner. The convex contact surfaces 12 of the guide portion 10 of the first switch contact piece 1 lie against the planar contact surfaces of the guide path 9. The entraining element 14 passes through the slot 13 that is embodied as an elongated hole and comprises a linear extension, wherein the axis of curvature of the convex contact surfaces 21 extends through the elongated hole. The entraining element 14 is embodied in such a manner that it comprises a planar contact surface 22 that lies against the planar flank of the slot 13, said flank being formed in a matching manner. The entraining element 14 comprises two planar contact surfaces 22 that are arranged in parallel with one another and engage in a similar manner with flanks of the slot 13, said flanks being arranged opposite one another. The entraining element 14 thus forms a sliding block. The embodiment of the entraining element 14 is illustrated in detail in FIG. 6. It is evident that the entraining element 14 comprises an essentially square cross section, wherein the corners are broken off in a rounded manner. The entraining element 14 comprises in each case parallel contact surfaces 22 that are embodied in a planar manner and simultaneously engage the flanks of the slot 13. Furthermore, it is evident that the entraining element 14 is mounted in a bushing 23. The bushing 23 is embodied from an abrasion-proof material, wherein the bushing 23 is connected to the entraining element 14 in an angular rigid manner. The bushing 23 is in turn positioned in a rotatable manner in the two-armed actuating lever 15, so that the entraining element 14 is mounted in such a manner that it can rotate with respect to the actuating lever 15. Consequently, it is possible that the entraining element 14 does not tilt in the slot 13 during a pivot movement of the actuating lever 15 despite the planar contact surfaces 22 being guided in the linear elongated hole of the slot 13.

Figure 6:
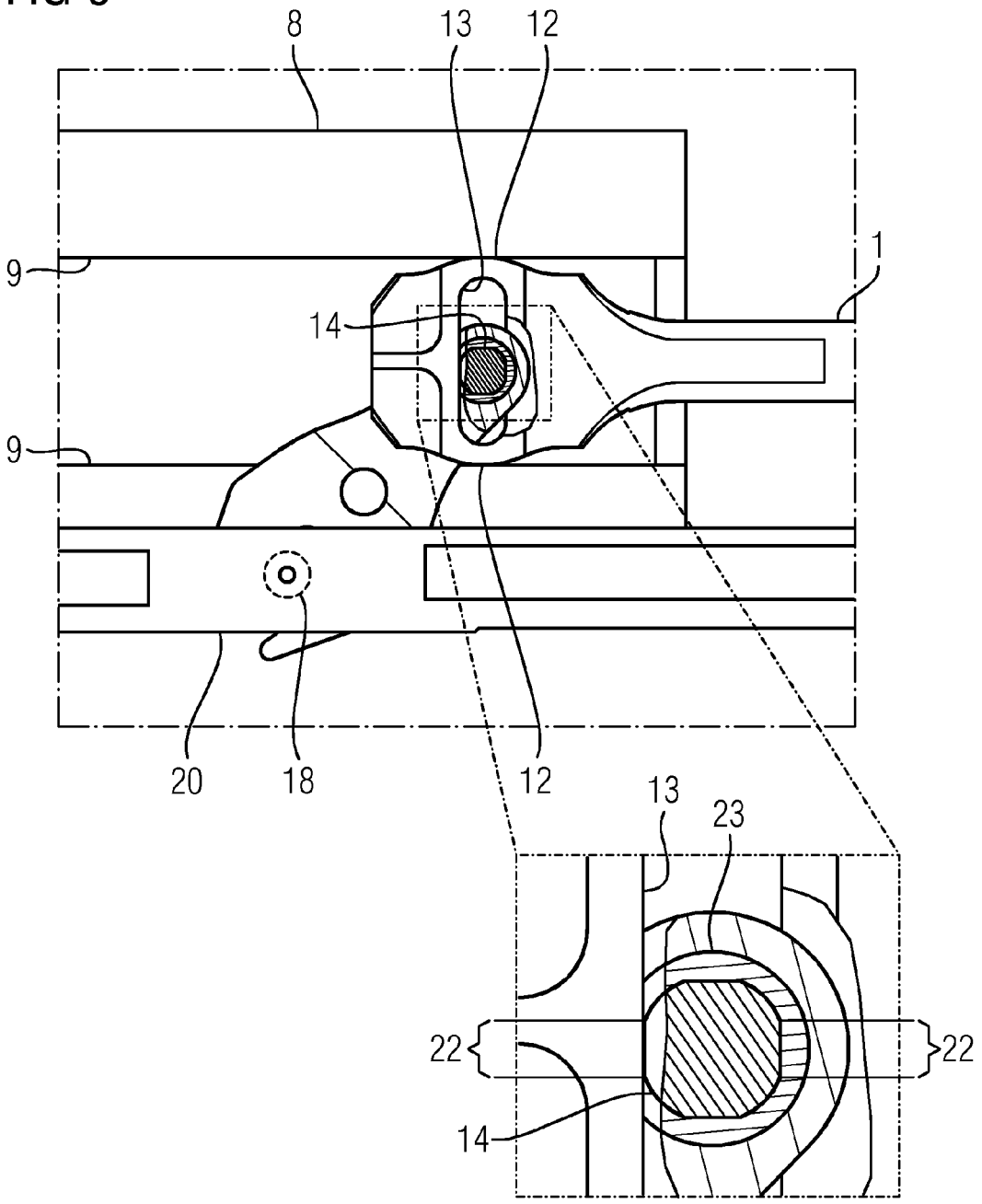
FIG. 6 illustrates a detail of a slot of a guide portion.
Figure 7:
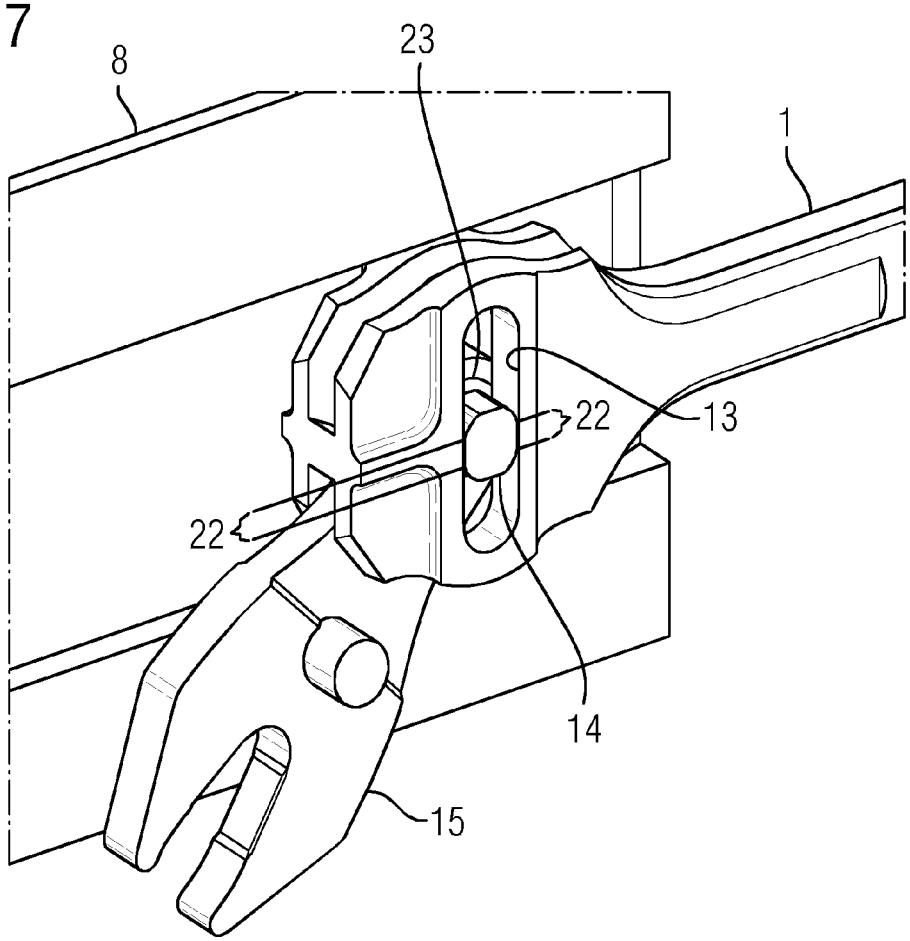
FIGS. 7, 7A illustrate a perspective view, in part cut-away, of an embodiment of a guide portion known from FIG. 5, FIGS. 8, 8A, 8B illustrate a first variant of an embodiment of an entraining element on the guide portion of a first switch contact piece.
Figure 7A:
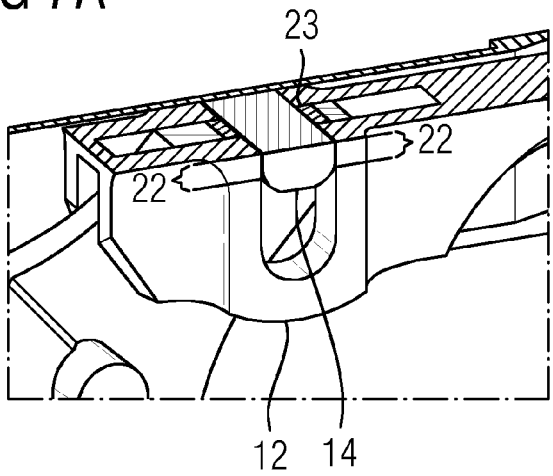

The FIGS. 7, 7A illustrate a perspective view of the known guide portions 10 shown in FIG. 6. The cut-away view illustrates in particular the position of the bushing 23 in the two-armed actuating lever 15. In this case, the bushing 23 is connected to the entraining element 14 at a fixed angle. It can also be provided that the bushing 23 encompasses the entraining element 14 in a rotatable manner and itself is fixed at a fixed angle in the actuating lever 15.

Figure 8:
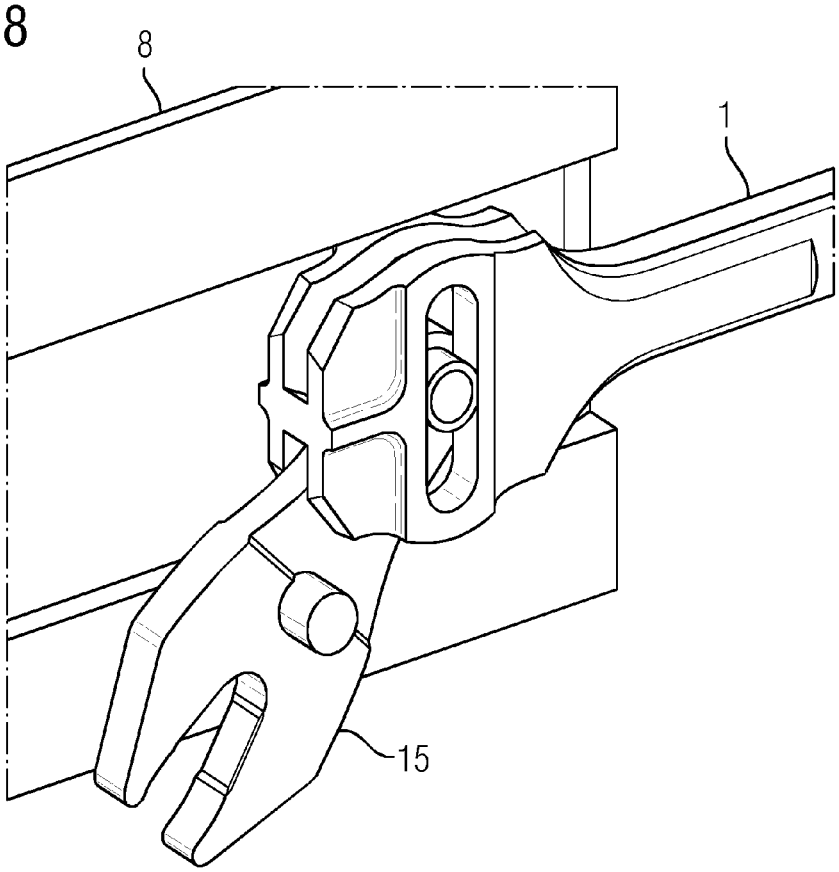
Figure 8A:
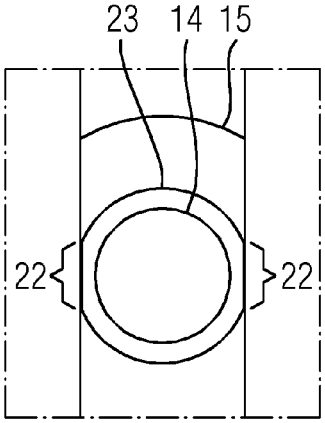
Figure 8B:
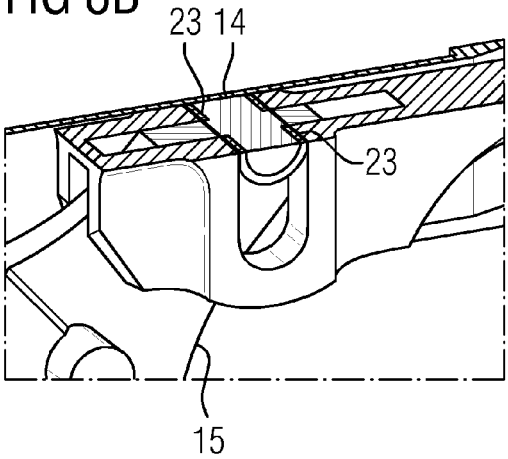

The FIGS. 8, 8A, 8B illustrate a first variant of an embodiment of an entraining element 14. A bushing 23 comprises planar contact surfaces 22, wherein the bushing 23 is mounted in a rotatable manner on the entraining element 14. The entraining element 14 is fixed in position on the two-armed actuating lever 15. As an alternative, the bushing 23 can be rigidly fastened to the entraining element 14 and the entraining element 14 can be mounted in a rotatable manner on the two-armed actuating lever 15.

In the case of the constructions illustrated in all the figures, the respective entraining elements 14 are guided in a parallel manner in two slots 13 that are arranged in an aligned manner. In a central region that is located between the slots 13, an arrangement for mounting the respective entraining elements 14 is provided on the respective two-armed actuating lever 15. In the case of the embodiment in accordance with FIGS. 8, 8A, 8B, a separate sleeve 23 is guided in each of the slots 13.

Figure 9:
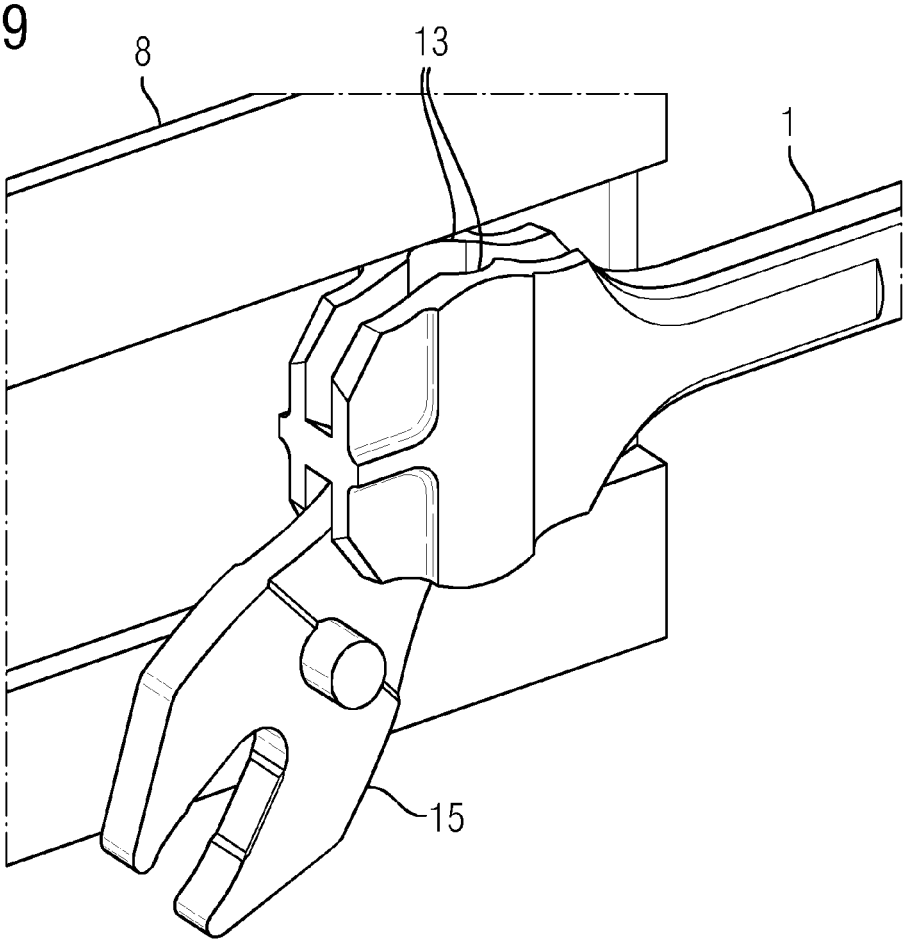
FIGS. 9, 9A illustrate a second variant of an embodiment of an entraining element on a guide portion of the first switch contact piece.
Figure 9A:
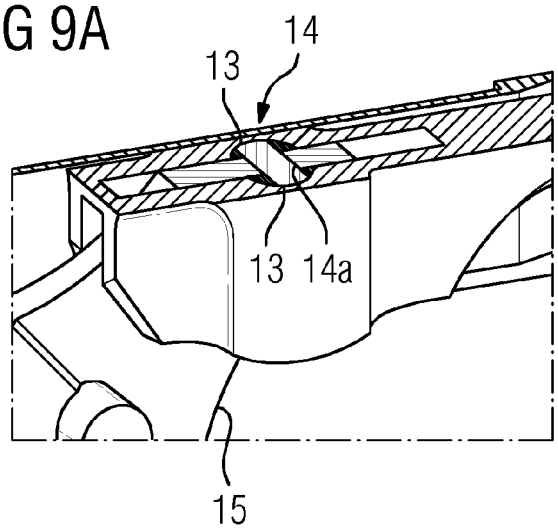

FIGS. 9, 9A illustrate a second variant of an embodiment of an entraining element 14. The entraining element 14 comprises a central pin 14*a* that passes through the two-armed actuating lever 15, wherein the pin 14*a* is raised at its free ends, in each case in the form of a spherical cap, above the two-armed actuating lever 15. As an alternative, the two-armed actuating lever 15 can be embodied by way of example also with spherical cap-shaped protrusions for the purpose of forming a entraining element 14. The spherical-cap shaped surfaces of the entraining element 14 engage in each case in a linear grove (slot 13) that comprise in each case preferably a semi-circular groove profile. Accordingly, the surface area of the contact region is increased, said contact region slides through the groove-shaped slot 13 during a pivot movement of the actuating lever 15 and causes the pivot movement of the two-armed actuating lever 15 to be converted into a linear movement of the first switch contact piece 1. By virtue of blocking the actuating lever 15 in the end positions by way of the fork ends, the entraining element 14 is prevented from moving out of the grooves.

Figure 10:
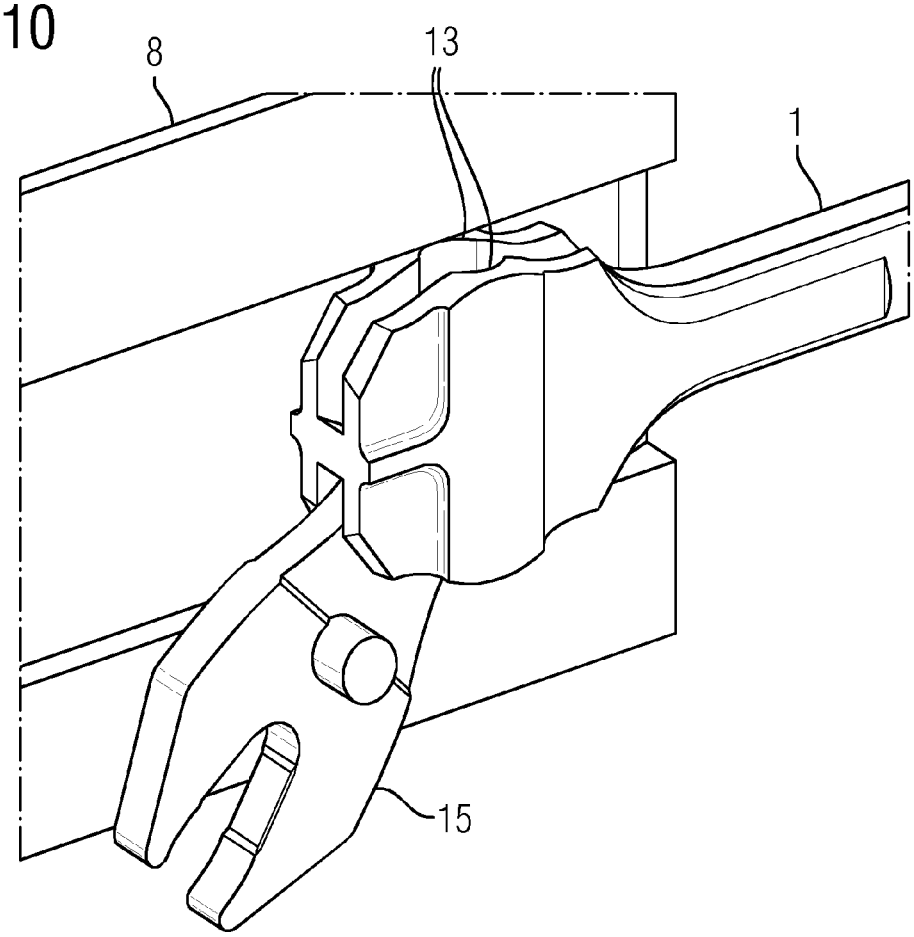
FIGS. 10, 10A illustrate a third variant of an embodiment of an entraining element on a guide portion of a switch contact piece.
Figure 10A:
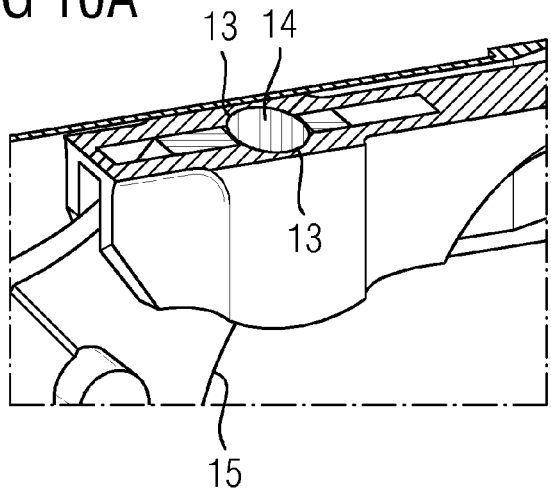

FIGS. 10, 10A illustrate a fourth variant of an embodiment based on the embodiment of a entraining element 14 known from FIGS. 9, 9A. In accordance with FIGS. 10, 10A, it is provided that a cylindrical through-going bore is provided in the two-armed actuating lever 15 and a spherical entraining element 14 is placed in said cylindrical through-going bore. The spherical entraining element 14 is in turn placed in two aligned slots 13 that preferably comprise two grooves that are arranged in opposite directions and comprise a matching profiled shape. By virtue of guiding the entraining element 14 in opposite directions in two similar slots 13, the spherical entraining element 14 is prevented from being pushed out of the through-going bore. By virtue of defining the pivot region of the two-armed lever 15, the spherical entraining element 14 is prevented from running out of the slot 13.

Figure 11:
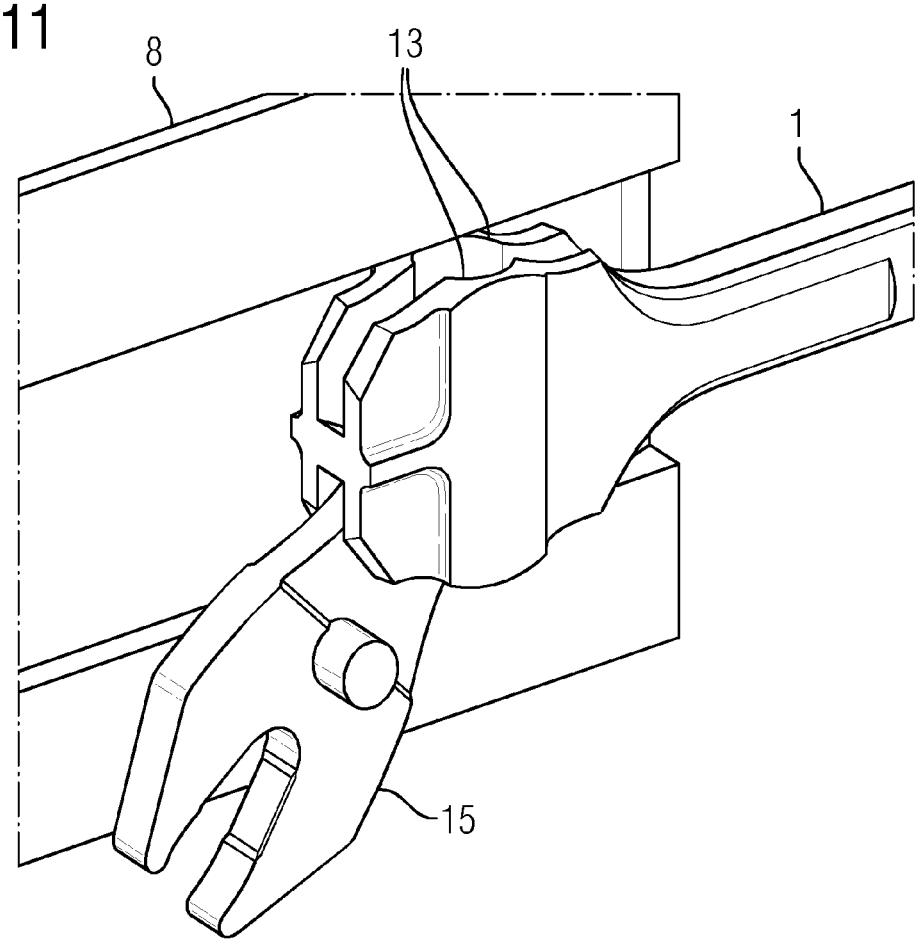
FIGS. 11, 11A illustrate a fourth variant of an embodiment of an entraining element on a guide portion of a first switch contact piece.
Figure 11A:
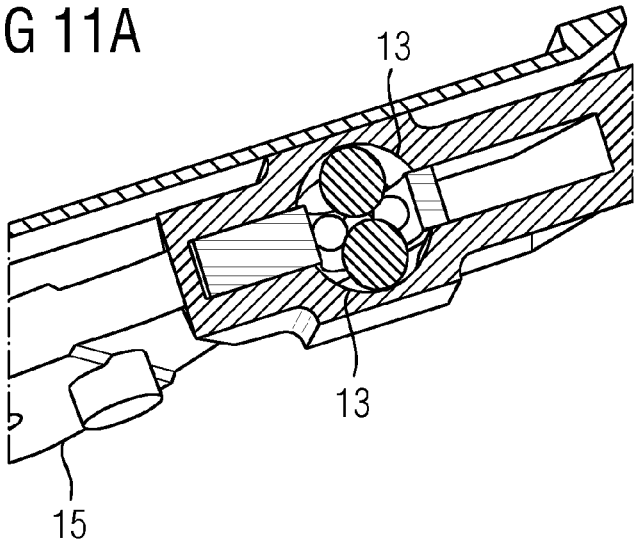

FIGS. 11, 11A illustrate a fourth variant of an embodiment of the entraining element 14 known from FIGS. 10, 10A in the form of a sphere, wherein in this case two spheres are used, the two spheres being guided in each case in a slot 13, wherein an annular ball bearing is provided for the purpose of positioning the two spheres of the entraining element 14 in a through-going bore of the actuating lever 15 and said annular ball bearing holds the spheres in opposite directions in the respective slots 13. The annular ball bearing guides the entraining element 14 in the radial direction in the through-going bore of the actuating lever 15 and presses the two spheres into the respective slots 13.

Figure 12:
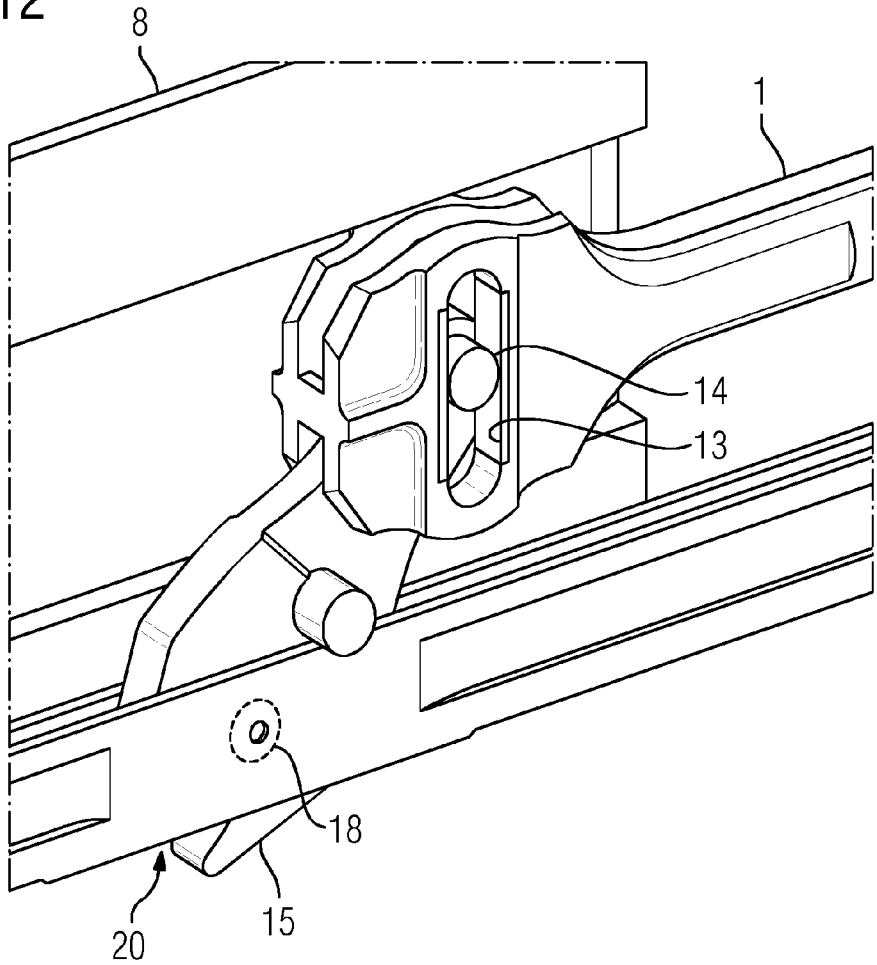
FIGS. 12, 12A illustrate a possible embodiment of contact surfaces.
Figure 12A:
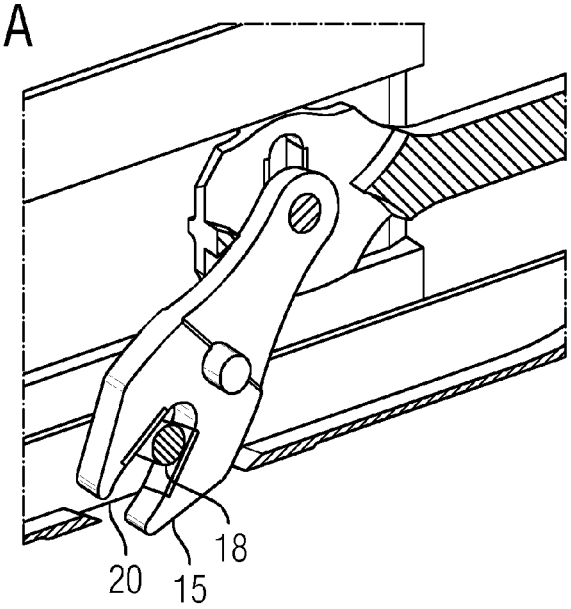

Irrespective of the embodiment of the entraining element 14, FIGS. 12, 12A illustrate that it is possible to provide as an alternative or in addition to a bushing 23 the use of an abrasion-proof insert also on the flanks of the slot 13. It is possible to attach inserts that are made from an abrasion-proof material into the flanks of the slot 13, said flanks being used as contact surfaces for the entraining element 14. Consequently, the slot 13 is prevented from bulging or rather expanding, wherein it is only necessary to manufacture from the abrasion-proof material those regions of the slot 13 that are at risk of being abraded.

Furthermore, it can be provided that inserts that are made from abrasion-proof material are provided in the contact surfaces of the fork-shaped end of the two-armed actuating lever 15, the actuating pin 18 moves into said fork-shaped end during a movement. The contact surfaces of the two-armed actuating lever 15 which are engaged by the actuating pin 13 or against which the actuating pin 13 comes to rest are also accordingly mechanically reinforced in this case, as a consequence of which any widening of the fork end of the two-armed actuating lever 15 as a result of bulging or rather abrasion is impeded.

The invention claimed is:

1. An electrical switching device, comprising:

a first switch contact piece and a second switch contact piece;

a guide path;

said first switch contact piece having a guide portion being displaceably guided along said guide path, said first switch contact piece having a slot formed therein and said slot having a flank;

an actuating unit; and a kinematic linkage connecting said actuating unit at least to said first switch contact piece for generating a relative movement between said switch contact pieces, said kinematic linkage having an entraining element engaging in said slot, and said entraining element having a planar contact surface lying against said flank of said slot;

said guide portion and said guide path being part of a rotate and slide joint connected to said kinematic linkage.

2. The electrical switching device according to claim 1, wherein:

said guide portion includes a contact surface lying on said guide path;

said guide path includes a contact surface lying on said guide portion; and at least one of said contact surfaces is convexly curved.

3. The electrical switching device according to claim 1, wherein one of said contact surfaces is planar.

4. The electrical switching device according to claim 1, which further comprises an actuating lever on which said entraining element is rotatably mounted.

5. The electrical switching device according to claim 4, wherein said actuating lever is pivotable.

6. The electrical switching device according to claim 4, which further comprises an abrasion-proof, rotatably-mounted bushing enclosing said entraining element.

7. The electrical switching device according to claim 2, wherein at least one of said contact surfaces has an abrasion-proof insert.

* * * * *